US006283331B1

(12) United States Patent
Lucas

(10) Patent No.: US 6,283,331 B1
(45) Date of Patent: Sep. 4, 2001

(54) CONTACT OPENING CAP FOR BOTTLES

(76) Inventor: Nathaniel Lucas, 5386 E. 81st St., #821, Tulsa, OK (US) 74137

( * ) Notice: Subject to any disclaimer, the term of this patent is extended or adjusted under 35 U.S.C. 154(b) by 0 days.

(21) Appl. No.: 09/557,899

(22) Filed: Apr. 21, 2000

(51) Int. Cl.[7] ..... B65B 3/04

(52) U.S. Cl. ..... 222/153.03; 222/153.07; 222/503; 222/559; 222/523; 222/509; 141/351; 141/364

(58) Field of Search ..... 222/153.03–153.07, 222/498, 499, 502, 503, 505–507, 509, 522, 523, 525, 527–532, 537, 559, 561; 141/291, 292, 351, 352, 357, 364; 62/389, 391

(56) References Cited

U.S. PATENT DOCUMENTS

| | | | | |
|---|---|---|---|---|
| 420,918 | * | 2/1890 | Noack, Jr. | 222/153.03 |
| 2,751,119 | * | 6/1956 | Manning, Sr. | 222/525 |
| 2,901,153 | * | 8/1959 | Collins | 222/525 |
| 2,992,761 | * | 7/1961 | Sommers, Sr. | 222/525 |
| 2,992,762 | * | 7/1961 | Forman | 222/525 |
| 3,245,587 | * | 4/1966 | Brown | 222/525 |
| 4,516,691 | * | 5/1985 | christine et al. | 222/522 |
| 4,903,742 | * | 2/1990 | Gagnon | 222/525 |
| 5,042,698 | * | 8/1991 | Fessell | 222/559 |
| 5,222,530 | * | 6/1993 | Baker et al. | 222/153.07 |
| 5,249,611 | * | 10/1993 | Law | 141/291 |
| 5,259,423 | * | 11/1993 | Simmel et al. | 141/357 |
| 5,297,703 | * | 3/1994 | Tsao et al. | 222/507 |
| 5,303,850 | * | 4/1994 | Connan | 222/153.07 |
| 5,456,387 | * | 10/1995 | Trewhella | 222/503 |

* cited by examiner

*Primary Examiner*—J. Casimer Jacyna
(74) *Attorney, Agent, or Firm*—William S. Dorman

(57) ABSTRACT

In a bottle of the type for inverted insertion and dispensing into a receiving tank or reservoir, the bottle having a bottle opening, a cap assembly attached to the neck of the bottle overlying and sealing the opening, the cap assembly comprising a first cap portion attached to the bottle opening, and a second cap portion having an exposed exterior top overlying the bottle opening and being telescopically mounted over the first cap portion, the second cap portion being moveable from a first position where it is fully extended away from the bottle to a second position where it is fully collapsed over the first cap portion, the first cap portion having openings therein to allow for flow, the second cap portion having openings therein, a flow passage being created when the second cap portion collapses over the first cap portion from contact resulting from inverted insertion into a dispenser or reservoir; whereby the openings in the first and second cap portions are aligned when the second cap portion moves to its second position so as to permit flow through the first and second cap portions.

5 Claims, 2 Drawing Sheets

CONTACT OPENING CAP FOR BOTTLES

This application is an improvement over the invention set forth in my prior U.S. Pat. No. 5,829,638 issued on Nov. 3, 1998 on CONTACT OPENING CAP FOR BOTTLE CONTAINERS. More particularly, the invention set forth in my prior patent involves a membrane which must be pierced or ruptured in order to provide flow from the bottle into the container. The membrane in the prior patent, therefore, must be replaced each time the cap assembly is used. The present invention involves an improvement where the flow is achieved by aligning apertures on moveable parts of the cap assembly which obviates the need to replace the membrane each time the cap is used.

BACKGROUND OF THE INVENTION

1. Field of the Invention

This invention relates to plastic caps for bottles (unthreaded types and threaded screw) that are placed upside down and into the receiving and dispensing tank of a dispenser; and for bottles (unthreaded type and threaded screw) or containers that are turned upside down for dispensing into a receiving tank or reservoir.

There are water companies that commonly supply users (home, office and industry) with five gallon and larger bottles to be placed upside down and into receiving and dispensing tanks of water dispensers. There are also petroleum companies that provide the user with bottles for dispensing petroleum products, such as oil, antifreeze, oil and gasoline treatment, brake fluids into receiving tanks of automobiles, high performance vehicles, boats/watercraft, motorcycles, lawn and garden equipment.

Five gallon water bottles are conventionally produced by manufacturers in two types. A first type of bottle is designed for plastic screw cap closure. A second type of bottle eliminates the screw threaded terminal at the upper end of the neck and substitutes a crowned configuration. Such bottles may be closed by a hermetically sealed plastic cap which attaches to the bottles mouth and neck. Bottles for petroleum products may vary in size, but the most common in use is the screw threaded one-quart size for dispensing oil. These bottles are typically recycled.

In use, the water bottle cap is first removed. Thereafter, the water bottle is inverted and placed in a receiving and dispensing tank of a dispenser. Likewise, the screw threaded one-quart size oil bottle cap is removed. The bottle is turned upside down for dispensing into a receiving tank or reservoir.

Lifting, rotating and placing the fifty-pound five gallon water bottle upside down and into the receiving and dispensing tank of a water dispenser, generates problems of stability and control when lifting, rotating and aligning the mouth of the bottle upside down and into the receiving and dispensing tank of a dispenser. Spillage occurs, and accidental injury from slippage can follow. With the screw threaded one-quart size oil bottle, spillage on a car engine and deck can occur causing slippage and injury, in addition to a messy clean up. If the engine is hot, spillage on the manifold covers can produce choking smoke, and the smell of burnt oil. This occurs when dispensing oil into the receiving tank or reservoir.

Regarding such lifting, rotating and placing of the bottle, the commencement of flow is a problem. Specifically, flow starts before the bottle is finally placed. There is no control over the start of the flow. Spillage results. Untidy, unsafe and even dangerous conditions can follow.

2. Prior Art

Some plastic caps of the prior art are removed from and others remain on the mouth of bottles or containers prior to placement in dispensers or over receiving tanks and reservoirs. They do not eliminate the problems of stability, control over handling of the bottle by the user when lifting, rotating, and aligning the mouth of the bottle in a dispenser or over a receiving tank and reservoir. U.S. Pat. Nos. 3,979,002 (Tearable Skirt Plastic Water Bottle Cap) to Faulstich (1976); 3,979,004 (Bottle Cap) to Bertario (1976); 3,985,255 (Bottle Cap) to Blair (1976); 4,302,029(Tamper-Proof Bottle Cap and Container) to Cochrane (1977); 4,106,653 (Tearable Bottle Cap) to Martinelli (1978); 4,884,707 (Water Bottle Cap) to Crisci (1989); 4,911,316 (Plastic Bottle Cap Sealing Plural Neck Profiles) to Tackles (1990) are all plastic caps that are removed completely from the bottle by grip tab prior to lifting, rotating and placing the bottle upside down and into a dispenser. They do not eliminate the problems cited above. U.S. Pat. No. 4,261,485 (Automatic Bottle Cap Having a Magnetically Actuated Valve) to Borg (1981) addresses issues that are no longer issues with subsequent art and this invention. U.S. Pat. No. 4,793,514 (Cap For Inverted Water Bottle) to Sheets (1988) has need for magnets to start the flow. A valve starts to open while being tipped, and closes when returned to the upright position. Flow starts before the bottle is in the inverted position, and cuts off as the bottle is returned to its upright position. U.S. Pat. Nos. 4,305,516 (Bottle Cap With Guaranteed Strip) to Perne' et al. (1981); 4,322,012 (Threaded Plastic Bottle Cap) to Conti (1982); 4,354,609 (Snap-On Tamperproof Bottle Cap) to Hidding (1982); 4,461,392 (Threaded Plastic Bottle Cap) to Conti (1984); 4,828,128 (Cap for Motor Oil Container) to Takcles (1989); 5,163,571 (Two-part plastic Bottle-Cap) to Marini (1992); 5,609,263 (Threaded Bottle Cap) to Perchedpied (1997); 5,913,437 (Tamper Evident Bottle Cap) to Ma (1999) are all plastic bottle caps that are removed completely from the bottle prior to lifting, rotating and placing the bottle upside down and into a receiving tank or reservoir. They do not eliminate the problems cited above. Further, all caps mentioned are not caps providing a flow through means. U.S. Pat. Nos. 5,123,555 (Container Cap Having External Bead) to Luch et al. (1992); 5,232,125 (Non-Spill Bottle Cap Used With Water Dispensers) to Adams (1993); 5,273,083 (Bottle Cap and Assembly For A Bottled Water Station) to Burrows (1993); 5,370,270 (Non-Spill Bottle Cap Used With Water Dispensers) to Adams et al. (1994); 5,392,939 (Valved Bottle Cap) to Hidding et al. (1995); 5,413,152 (Bottle Cap and Valve Assembly For A Bottled Water Station) to Burrows (1995); 5,542,555 (Valved Bottle Cap) to Hidding et al. (1996); 5,653,270 (Bottle Cap and Valve Assembly For A Bottled Water Station) to Burrows (1997); 5,829,638 (Contact Opening Cap For Bottle Containers) to Lucas (1998); 5,868,281 (Non-Spill Bottle Cap) to Bietzer et al. (1999); 5,904,259 (Protective Taper-Evident label and Bottle Cap) to Hidding et al (1999); 5,909,827 (Non-Spill Bottle Cap) to Bietzer et al. (1999); 5,957,316 (Valved Bottle Cap) to Hidding et al. (1999) are all caps that requires a puncturing means to initiate flow when the bottle is placed upside down and into a dispenser or receiving tank or reservoir.

SUMMARY OF THE INVENTION

In a bottle of the type for inverted insertion and dispensing into the receiving and dispensing tank of a dispenser; or into a receiving tank or reservoir, the bottle has a bottle body, a bottle neck terminating in a bottle opening, a cap assembly overlying and sealing the opening, an improvement to the cap assembly is disclosed. The cap assembly attaches to the bottle at the neck overlying the opening. Two portions of the cap assembly are present: A first cap portion attached to the cap assembly over the bottle opening, and a second cap portion having an exposed exterior top overlying the bottle opening and includes an interior surface exposed to the bottle opening. The first cap portion has screw threads and has openings in its top to allow for flow. The second cap portion has openings in its top, and which align with openings in first cap portion, to allow for flow from the first cap portion through the second cap portion. This second cap portion is movable telescopically with respect to the first or lower cap portion and can assume one of two different positions. The first position of the second cap portion is when it is fully extended away from the bottle. The second position of the second cap portion is when it has been pushed toward the bottle as a result of its insertion into an opening in a container so that it moves to a collapsed condition of the cap assembly where the openings in the two cap portions are aligned, so that flow is permitted. A flow passage is defined when the second cap portion collapses over the first cap portion to align the openings from the contact of inverted insertion into a dispenser or a reservoir; and for permitting flow through the first and second cap portions. Dispensing occurs. A seal is formed when the second cap portion is fully extended, or at its first position away from the bottle opening. Locking pins are added to maintain the seal position of the first and second cap portions, and to prevent second cap portion from inadvertent movement to the second position towards the first cap portion.

OBJECTS AND ADVANTAGES

Accordingly, besides the objects and advantages of the plastic cap described in the above Lucas patent, several objects and advantages of the present invention are:

(a) to provide a cap when attached to the mouth of a bottle providing a means to control and prevent the start of flow from the bottle while the bottle is being lifted, rotated and placed upside down and into a receiving and dispensing tank of a dispenser, or turned upside down for dispensing into a receiving tank or reservoir;

(b) to provide a cap when attached to the mouth of a bottle eliminates problems of stability, alignment, control, handling of the bottle by the user, spillage when lifting, rotating, and aligning the mouth of the bottle to a dispenser or receiving tank or reservoir;

(c) to provide a cap of a bottle that is completely reusable by the user (home, office, and industry) of the bottle;

(d) to provide a cap of a bottle that is totally recyclable;

(e) to provide a reusable and replaceable cap which can be sold as a separate item from the bottle to the user (home, office and industry);

(f) to provide a cap when attached to the mouth of a bottle seals and protects the mouth of the bottle when the bottle is lifted, rotated, and placed upside down and into the receiving and dispensing tank of a dispenser or receiving tank or reservoir where contamination of the bottle mouth and bottle contents from handling and from the environment is not an issue;

(g) to provide a cap, where the cap functions as a resealable/re-usable seal, and a seal or membrane does not have to be replaced. The cap reseals itself; and is the seal.

(h) to provide a cap, where the cap functions as a one unit valve and plug, and the valve is the cap assembly; and a plug or valve is not inserted in a cap well; and where there is no need for a cap well.

(i) to provide a cap, where there is no need for a probe, tube, piercing element, guide, and sleeve.

(j) to provide a cap, where the cap opens on contact for dispensing into a dispenser or a receiving tank or reservoir; and there are no severed members that could end up in the bottle.

(k) to provide a cap that is self locking and self-sealing, preventing inadvertent opening and contamination.

(l) to provide a cap which is able to reduce itself in size when in use and is simpler and cheaper to manufacture using existing plastic materials, processes and set-ups for current caps that are mass-produced, light weight, made of a single material, and is not an integral part of the bottle.

(m) to provide a cap where the weight of the bottle and contents on top of a second cap portion when contact with the bottom surface of the water receiving and dispensing tank of a dispenser pushes on the top of the cap and relieves the seal and aligns the openings of the second cap portion over the openings of the first cap portion starting flow.

(n) to provide a cap when contact to the second cap portion is made with any solid object in the receiving tank, the cap collapses, the seal relieves, aligning the openings of the second cap portion over the openings of the first cap portion starting flow.

(o) to provide a cap where the use of hands are not required to produce flow after the bottle mouth is placed inside the receiving and dispensing tank of a dispenser and a receiving tank.

(p) to provide a cap where locking pins or a circumferential external bead or bevel (friction locked) serve to prevent the second cap portion from collapsing over the first cap portion from handling, transporting, and producing unwanted flow.

(q) to provide a cap where the cap assembly is the seal that repeatedly becomes a reusable seal. The cap assembly reseals when re-extended to its full position.

BRIEF DESCRIPTION OF THE DRAWINGS

In the accompanying drawings, forming a part of this application, and in which like numerals are used to designate like parts throughout the same.

DESCRIPTION OF THE PREFERRED EMBODIMENTS

Figure 1:
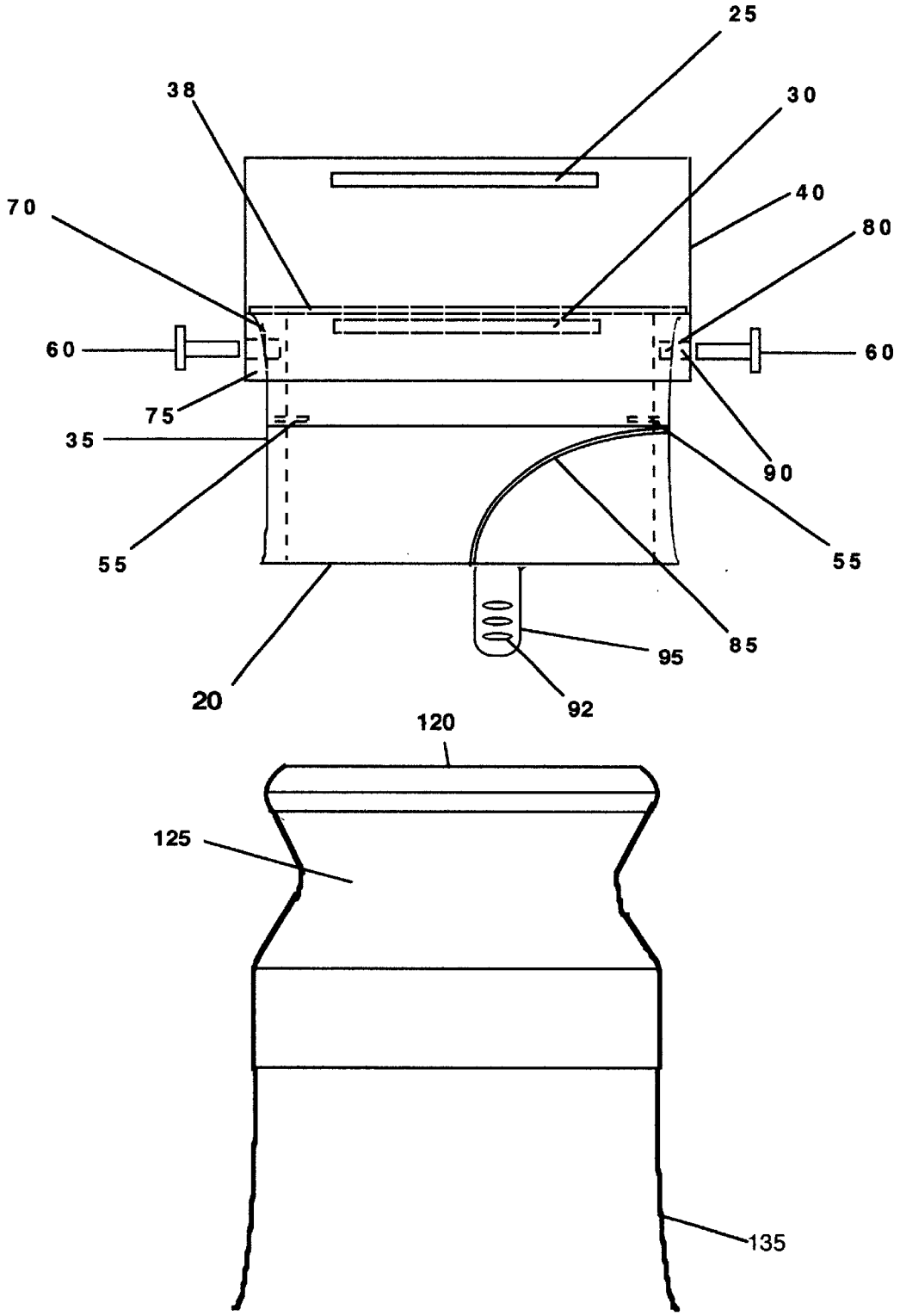
FIG. 1 is an exploded side elevation of one configuration of an unthreaded cap and an unthreaded bottle in accordance with this invention.

Referring to FIG. 1, unthreaded bottle 135 is illustrated having bottle opening 120 and exterior of bottle neck 125. Exterior of bottle neck 125 is the surface to which unthreaded cap assembly 20 fastens for closure during transport. Unthreaded cap assembly 20 can also be referred to as the cap assembly.

Unthreaded cap assembly 20 includes two portions. A first cap portion 35 consists of an unthreaded vertical lower and inner cylindrical element. This unthreaded vertical lower and inner cylindrical element 35 remains fixed to the bottle and has two defined openings or apertures 30 positioned 180 degrees opposite each other, two recessed openings 80 positioned 180 degrees opposite each other, and an immovable internal circumferential ring 55. Like a conventional bottle cap, cap assembly in its extended position seals transported liquid within unthreaded bottle 135 during transport. When the cap assembly collapses, liquid can flow from the inverted bottle.

This second cap portion 40 is moveable telescopically with respect to the first or lower cap portion 35 and can assume one of two different positions. The first position of the second cap portion 40 is when it is fully extended as shown in solid lines in FIG. 1. The second position of the second cap portion is when it has been pushed as a result of its insertion into and opening in a container so that it moves downwardly with respect to the first and lower cap portion until the openings in the two cap portions are aligned so that flow is permitted.

The second and relatively movable cap portion of the cap assembly includes a vertical upper and outer cylindrical element 40 which is mounted telescopically over the first cap portion. This cylinder 40 has two defined openings or apertures 25 positioned 180 degrees opposite each other and two defined openings or apertures 90 positioned 180 degrees opposite each other. When locking pins 60, which prevent cap assembly from collapsing inadvertently, are removed from the opening 80, the cap assembly collapses from contact, aligning two equally sized and defined openings or apertures 25 over two equally sized and defined openings or apertures 30, permitting the outflow of the liquid from the bottle. Thus the vertical cylindrical wall of vertical upper and outer cylindrical element 40 transmits the force that causes collapsing of the cap assembly. As is conventional, unthreaded vertical lower and inner cylindrical element 35 includes an outside top annulus or lip 38 which interferes with an inside bottom annulus or ring 75 of vertical upper and outer cylindrical element 40 to prevent complete separation of the relatively moving members. The annulus 75 on the lower inside surface of the upper cap portion 40 consists of an immoveable internal ring which is also contoured to correspond with the shape of the outer surface of the lower cap portion 35 below the lip 38.

The cap assembly in extended position causes an interference fit and seal at 70 between vertical upper and outer cylindrical element 40 and unthreaded vertical lower and inner cylindrical element 35 sealing unthreaded bottle 135.

It will be understood that the vertical upper and outer cylindrical element 40 can telescope over unthreaded vertical lower and inner cylindrical element 35 during cap operation. Specifically, such movement occurs from that disposition shown in FIG. 1 to and towards a disposition where apertures 25 and 30 become aligned. When this occurs, transported liquid can flow from unthreaded bottle 135 out through aligned apertures 25 and 30.

It should be noted that during cap transport, relative movement between vertical upper and outer cylindrical element 40 and unthreaded vertical lower and inner cylindrical element 35 is to be prevented. To this end, there are provided locking pins 60 which are received in openings 80.

It will be understood that unthreaded cap 20 can be removed from unthreaded bottle 135 along external score line 85. This respective external score line 85 enables separation of unthreaded vertical lower and inner cylindrical element 35 by grip tab 95 (with vertical ribs 92 to provide convenient gripping). It will also be understood that there can be gussets along external score line 85 to provide stiffness, and to cause tearing only along score line. The gussets allow for a quick, clean and smooth tear along the score lines, and quick removal of cap assembly.

It should be pointed out that unthreaded cap 20 can be sized with respect to the depression within a dispenser and a receiving tank or reservoir (not shown as is conventional). Such dispensers and receiving tanks or reservoirs have a depression for receiving liquid of finite depth. By sizing, unthreaded cap 20 bottoms out at the top of the vertical upper and outer cylindrical element 40 in liquid dispensers, or from contact of inverted insertion into a reservoir. Automated opening will occur under the weight of liquid within unthreaded bottle 135 when it is inverted and placed into and makes contact with bottom of the liquid dispenser, or from contact from inverted insertion into a reservoir.

Figure 2:
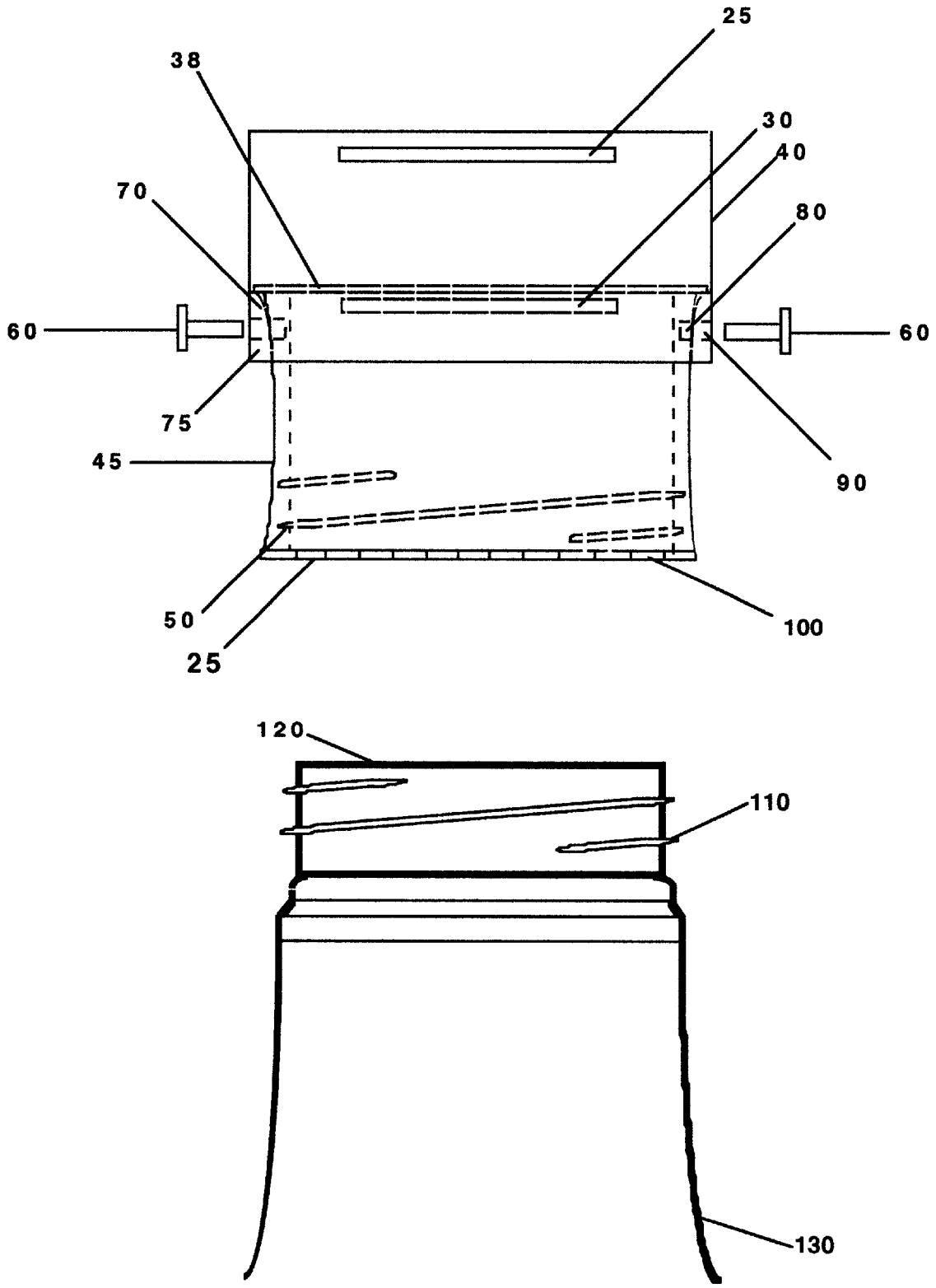
FIG. 2 is an exploded side elevation view of one configuration of a screw threaded cap and screw threaded bottle in accordance with this invention.

It will be understood that this cap can as well be adapted to screw threaded bottle 130 having external screw thread of slightly more than two turns 110 about bottle opening 120 (See FIG. 2). This can be done by supplying screw threaded cap 22 with internal screw thread 50 interior of threaded vertical lower and inner cylindrical element 45. A tamper seal 100 may be provided. The threaded embodiment of the present invention as shown in FIG. 2 provides a reusable cap assembly.

It should appear that the locking pins can be substituted with circumferential external bead or bevel on either vertical lower and inner cylindrical elements 35 and 45 or be interference fitted at 70 to lock (friction locked) vertical upper and outer cylindrical element 40 to vertical lower and inner cylindrical elements 35 and 45, which serves to prevent the second cap portion from collapsing over the first cap portion from handling, transporting, and producing unwanted flow.

It will be noted that paper seals or adhesive plastic strips can be placed over the apertures to prevent contamination from the environment.

If desired, the apertures can be sized to allow for thicker or thinner liquid flows.

Furthermore, it must be emphasized that this invention will admit of other variations. For example, it can be used on closures other than water or oil bottles.

What is claimed is:

1. In a bottle for inverted insertion to a dispenser or reservoir, the bottle having a bottle neck terminating in a bottle opening, a cap assembly overlying and sealing the bottle opening, the improvement to the cap assembly as overlying and sealing the bottle opening including:

a first cap portion attached to the bottle neck about the bottle opening, the first cap portion including apertures for liquid passage;

a second cap portion having a top including an interior surface exposed to the first cap portion and bottle opening, the second cap portion including apertures for liquid passage;

the second cap portion mounted for reciprocal movement on the first cap portion so that the second cap portion is moveable from a first position where the second cap is extended away from the bottle to a second position where the second cap has moved toward the bottle such that the apertures on the two cap portions are aligned, and;

liquid passage means defined on the first cap portion and second cap portion for permitting liquid to flow through the apertures of the first cap portion and second cap portion when the second cap portion is at its second position.

2. In a bottle for inverted insertion to a dispenser and a reservoir, the bottle having a bottle neck terminating in a bottle opening, a cap assembly overlying and sealing the bottle opening, the improvement to the cap assembly as overlying and sealing the bottle opening according to claim 1 and further including;

a locking means attached between the first cap portion and the second cap portion to maintain the second cap portion separated from the bottle opening at its first position and for inhibiting movement between the first cap portion and the second cap portion; and for preventing unwanted liquid passage;

tab means attached to the first cap portion for removal of the cap assembly from the bottle opening.

3. In a bottle for inverted insertion to a dispenser and a reservoir, the bottle having a bottle neck terminating in a bottle opening, a cap assembly overlying and sealing the bottle opening, the improvement to the cap assembly as overlying and sealing the bottle opening according to claim 1 and further including;

a first telescoping portion attached to the first cap portion;

a second telescoping portion attached to the second cap portion, the second telescoping portion interacting with the first telescoping portion in telescoping relation during movement of the second cap portion toward the first cap portion.

4. In a bottle for inverted insertion to a dispenser and a reservoir, the bottle having a bottle neck terminating in a bottle opening, a cap assembly overlying and sealing the bottle opening, the improvement to the cap assembly as overlying and sealing the bottle opening according to claim 1 and further including:

means for attaching the first cap portion to the bottle includes means for gripping a defined annulus on the bottle neck adjacent the bottle opening.

5. In a bottle for inverted insertion to a dispenser and a reservoir, the bottle having a bottle neck terminating in a bottle opening, a cap assembly overlying and sealing the bottle opening, the improvement to the cap assembly as overlying and sealing the bottle opening according to claim 1 and further including:

means for attaching the first cap portion to the bottle includes threads on the first cap portion for mating corresponding threads on the neck portion of the bottle adjacent to bottle opening.

* * * * *